United States Patent [19]

Rose et al.

[11] Patent Number: 4,979,630

[45] Date of Patent: Dec. 25, 1990

[54] AMPOULES

[75] Inventors: Howard Rose, Warrington; Ian G. C. McAfer, Westerham, both of Great Britain

[73] Assignee: Waverley Pharmaceutical Limited, Runcorn, United Kingdom

[21] Appl. No.: 305,549

[22] Filed: Feb. 3, 1989

[30] Foreign Application Priority Data

Feb. 3, 1988 [GB] United Kingdom ..... 8802349

[51] Int. Cl.[5] ..... A61J 1/06; B65D 12/28

[52] U.S. Cl. ..... 215/32; 206/530; 206/532; 141/310

[58] Field of Search ..... 215/32, 33, 1 C, 31; 206/364, 528, 530, 532; 141/310; 604/403, 404, 415; 222/541; D9/370

[56] References Cited

U.S. PATENT DOCUMENTS

| | | | |
|---|---|---|---|
| D. 259,213 | 5/1981 | Pagels . | |
| 1,382,163 | 6/1921 | Beccari | 215/32 |
| 4,175,597 | 11/1979 | Peterson | 604/403 X |
| 4,317,448 | 3/1982 | Smith | 604/403 |
| 4,512,475 | 4/1985 | Federighi | 215/32 X |
| 4,558,793 | 12/1985 | Hansen | 215/32 |
| 4,588,090 | 5/1986 | Spuck et al. | 206/532 |
| 4,643,309 | 2/1987 | Evers | 206/364 X |
| 4,787,536 | 11/1988 | Widerstrom | 206/532 X |

FOREIGN PATENT DOCUMENTS

| | | | |
|---|---|---|---|
| 88056 | 7/1983 | European Pat. Off. . | |
| 805846 | 5/1951 | Fed. Rep. of Germany | 141/310 |
| 2439312 | 6/1976 | Fed. Rep. of Germany . | |
| 3439420 | 4/1986 | Fed. Rep. of Germany | 604/403 |
| 572176 | 9/1945 | United Kingdom | 215/32 |
| 2039267 | 8/1980 | United Kingdom | 215/32 |
| 2043582 | 10/1980 | United Kingdom | 215/32 |

OTHER PUBLICATIONS

European Search Report for EP 89301101.5, 12/20/89.

*Primary Examiner*—Sue A. Weaver
*Attorney, Agent, or Firm*—Waldron & Associates

[57] ABSTRACT

The present invention provides plastics ampoules made by the blow-fill-seal method which substantially overcome the problems of vacuum formation and touch contamination, during use, by providing one or more grooves in the neck of the ampoule to allow replacement of displaced liquid with air and/or a head sealed to the mouth of the opening by a frangible membrane and tapering up towards a grip away from the opening, and optionally a funnel leading to the neck, this funnel also assisting docking of the head of a syringe.

13 Claims, 3 Drawing Sheets

FIG. 1
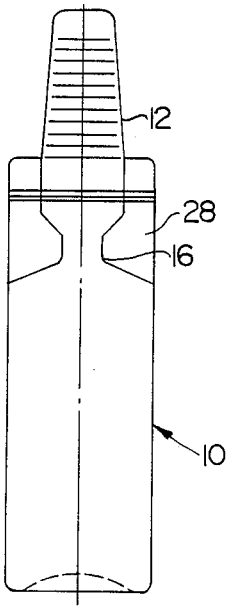
FIG. 2
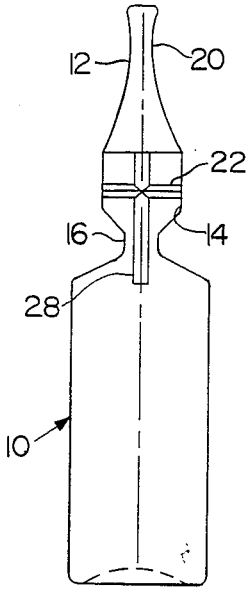
FIG. 3
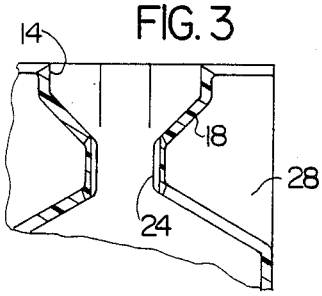
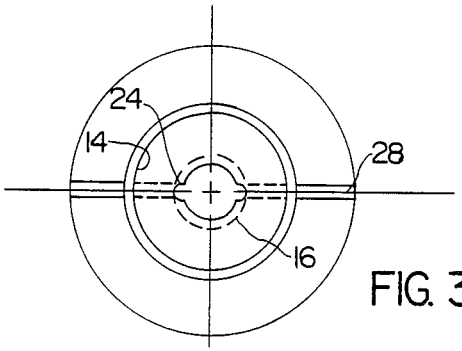
FIG. 3A
FIG. 4
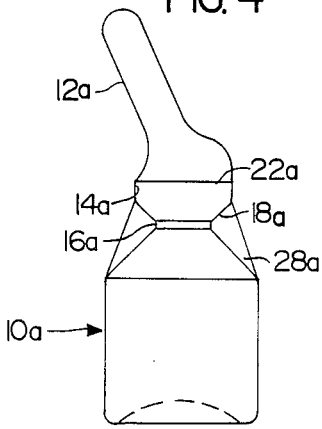

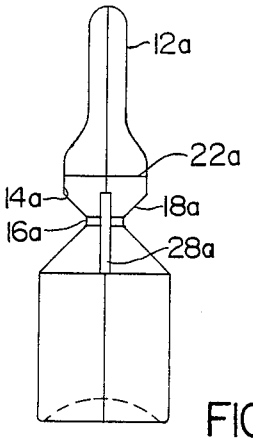
FIG. 5
FIG. 6
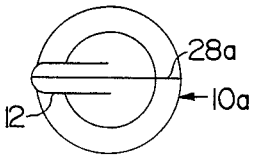
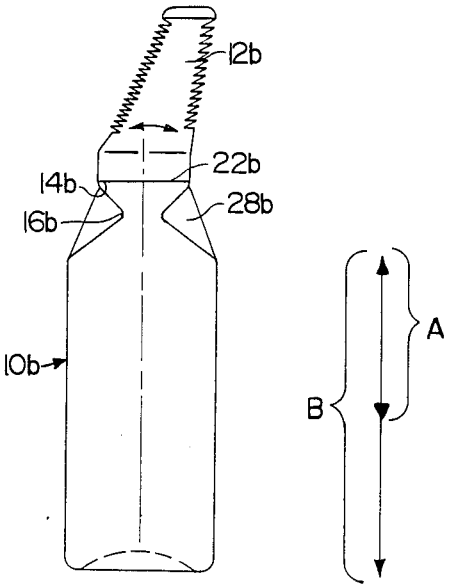
FIG. 7
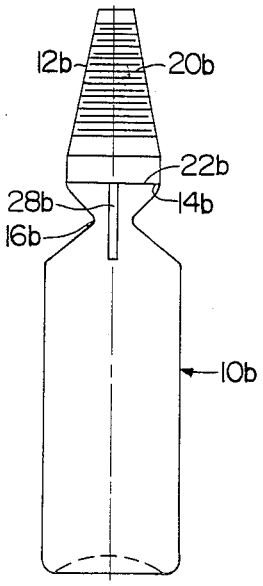
FIG. 8

AMPOULES

FIELD OF THE INVENTION

The present invention relates to plastics ampoules, having snap-off heads, for pharmaceutical use, and especially to ampoules for liquids for injection into a patient.

PRIOR ART

Ampoules are traditionally made of glass, and are widely adopted for sterile storage of liquids intended for pharmaceutical use. For example, glass ampoules can be used for pharmaceutically active solutions for direct injection, as well as for water, saline solution or other liquids which are employed for preparing injections by reconstitution or dilution.

The use of glass ampoules gives rise to several disadvantages. A glass ampoule is opened by breaking off the head, leaving an exposed neck with a dangerous cutting edge. There is a high risk that the user, such as a nurse, might cut themselves on the exposed edge, generating a risk of cross-infection. Fragments of glass are also generated and increase this risk. In addition microfragments of glass may intermingle with the liquid in the ampoule, and can thereafter be injected into the patient.

In the typical procedure for preparing an injection, a first disposable needle with sheath is fitted on the luer head of a syringe, the sheath is temporarily removed, and the liquid in the ampoule is drawn up into the syringe to a required volume. The needle is normally resheathed and discarded, to be replaced by a second fresh needle of smaller diameter for the actual act of injection. This procedure inevitably includes the risk that the user will stick the needle into himself, further increasing the possibilities for cross-infection.

After use, the ampoule, syringe and needles are thrown away. Such dangerous objects, collectively included within the term "sharps", are supposed to be safely discarded in accordance with set procedures. However, such procedures are not invariably followed. There are several reports in the literature of infection of hospital staff with AIDS through infection by sharps present in waste material.

In general, there is a desire to replace glass ampoules with safer materials.

Ampoules made of plastics material such as polyethylene, polypropylene and polyvinyl chloride are known, and are usually moulded, filled and sealed using machines manufactured and sold, for example, by Kocher Plastik and Rommelag AG. as well as Weiler Engineering Inc. Such plastics ampoules are typically made by the blow-fill-seal method, a technique which blow-moulds the ampoule, and then fills and seals it in one continuous operation. This technique minimises the risk of contamination of the ampoule prior to use.

Numerous designs of plastics ampoule have been devised, including the use of a twist-off head and a female luer neck. Such ampoules are disclosed in EP-A-0 088 056, the ampoules having a standardised (luer) female cone intended for air-tight connection with the male head of a syringe, and a twist-off cap which seals the ampoule prior to use. Such a design reduces the risk of needle stick injuries as the male luer head of the syringe is directly mated to the ampoule for filling, without the need for a first disposable needle.

There is a particular problem associated with ampoules, whatever the material used for their construction. When inserting the needle, or male luer, of a syringe, it is desirable to ensure a snug fit to ensure accurate dispensing, such as is described in EP-A-0 088 056 (supra). When the contents of the ampoule are taken up, there is a corresponding decrease in pressure which can cause the collapse of plastics ampoules, rendering further uptake difficult or impossible, and it can lead to breakage or resistance to uptake in glass ampoules. The extra pressure needed to withdraw the last of the contents also enhances the risk of an accident. Incorporation of an air bubble reduces the risk but exposes the ampoule contents for extended periods, to the possibility of oxidation, and cannot entirely negate the reduction of pressure in any case. Further, the gas may diffuse into the solution, and the more air in the ampoule, the greater the risk.

Existing designs of ampoule are also subject to 'touch contamination', that is, contamination of the ampoule or syringe head by physical contact during, or after, the act of breaking the seal. Indeed, with some designs, such contamination is inevitable.

OBJECTS OF THE INVENTION

It is an object of the present invention to provide an ampoule wherein withdrawal of the contents does not lead to an inconvenient drop in pressure.

It is also an object of the present invention to provide an ampoule having a reduced risk of touch contamination.

It is a further object of the present invention to provide an ampoule which reduces the risk of touch contamination of the head of a syringe.

It is a yet further object of the present invention to provide an ampoule which facilitates mating of the syringe head with the neck of the ampoule.

SUMMARY OF THE INVENTION

The present invention provides a plastics ampoule having an opening comprising a dispensing neck, a removable head sealing the opening, characterized in that the neck further comprises vacuum-relief means to prevent a build up of vacuum within the ampoule on withdrawal of its contents by a syringe.

In an alternative aspect, the present invention provides a plastics ampoule having an opening comprising a dispensing neck, a removable head sealing the opening, characterised in that the base of the head corresponds to the contours of the opening and is sealed thereto by a frangible portion, the head extending away from the opening and tapering towards a grip, the ampoule optionally further comprising vacuum-relief means as defined.

The present invention further provides a plastics ampoule as defined, wherein the opening further comprises a funnel leading to the neck.

DETAILED DESCRIPTION OF THE INVENTION

The vacuum-relief means of the invention preferably comprises one or more grooves or channels connecting the inner cavity of the ampoule with the outside.

By 'vacuum' is meant any pressure lower than ambient.

It has been found that such an arrangement does not lead to any loss of liquid, while ensuring that the internal pressure of the ampoule causes no problems, and it also has the advantage that undersirable exposure of the contents to air is minimised.

In one embodiment, the neck is provided with two diametrically opposed grooves, running directly into the ampoule. As the liquid is taken up, air enters via the grooves to replace the displaced volume of liquid. While the liquid is being drawn up, there is a natural tendency for the greater external pressure to force air in, thus preventing escape of the contents. This effect is augmented by the effects of surface tension which will usually prevent escape of the liquid even when there is no pressure differential.

For ease of manufacture, it may be preferable to provide the channels by appropriate shaping of the neck. Thus, for example, to provide two channels, the neck cross-section can be made oval, the larger diameter providing the channels and the smaller diameter gripping the syringe head. Other configurations are equally possible, such as a generally rounded triangular cross-section to provide 3 channels, or a square cross-section for 4 channels, although two channels are generally preferred.

The removable heads of the invention can be gripped by a user and removed, for example by a twist-off action to encourage shearing at a break line. The twist-off, or snap-off, head typically extends from a circular base and develops into a thin grip, transforming from a circular cross section to a generally rectangular cross-section, or thinner rod-like section, through a tapering portion. The portion to be gripped is preferably in the form of a tab or other thin grip, and suitably has a moulded surface to facilitate gripping.

In one embodiment, the head extends from the break-line to an angled, rod-like grip, tapering from a wide, optionally circular, cross-section to a narrower substantially circular cross-section, solid or hollow, at an angle from the vertical. Pulling the rod-like grip towards the vertical exerts stress on the break-line under the grip, breaking off the head.

In another, preferred embodiment, the head extends upwards from a generally circular base transforming to an angled, tapering grip. As with the previous embodiment, pulling the grip towards or away from the vertical breaks the frangible seal.

In general, it is preferred that the removable head is designed so as to enhance the sterility in use. The presence of the head over the target aperture maintains sterility of the internal surface of the aperture, transition zone and neck, until its removal. The head is preferably designed so that the user does not tend to finger the aperture. For example, a flared twist-off head may act as a shield or guard, and the tapering portion minimises the risk of introducing infection.

This effect can be enhanced, for instance, by providing ancilliary guards in the general plane of the thin grip and extending diametrically of the base of the head.

Such heads serve to further prevent touch contamination, as the region acted upon by the user to break the seal is remote from the break-line.

The dangers of touch-contamination may be further overcome by the incorporation of a funnel in the design of the ampoule. Thus, it is preferred that the opening of the ampoule formed by removal of the head exposes a relatively wide aperture leading to the neck, which may be, for example, a female luer. The relatively wide aperture can act as a docking target for capturing the male luer of a syringe. The docking target area then leads inwardly to the neck, serving to funnel the syringe male luer towards engagement with the ampoule neck.

Inadvertent physical contact with the funnel is of little importance as the male head of the syringe docks with the neck of the ampoule and not the funnel. The risk of touch-contamination is, thus, very much reduced. Furthermore, the provision of a funnel, or docking target, further facilitates the operation of syringe loading, avoiding fiddly connection of syringe and ampoule, which can lead to contamination, and saving time, which can be of the essence if many injections are necessary. Missing the target with the male head is rendered unlikely, reducing the chance of the head becoming contaminated through physical contact.

In its capacity as contamination preventative, the shape of the funnel is of little consequence, although it is preferable that the male head of the syringe be obliged to pass through the funnel before engaging the neck. For practical purposes, the contours of the funnel will normally be rounded to avoid catching and for ease of moulding. Also, in order to assist the engagement of the syringe head with the neck, it is generally preferable that the funnel has a gradual transition from the wider opening to the narrower neck, rather than having an essentially tubular shape with the neck located in the base wall.

The aperture, or target area, of the funnel suitably has an internal cross-sectional area which is at least 3 or 4 times the minimum internal cross-sectional area of the neck.

The target area is preferably of circular or generally curved (including oval) shape. The shape of the target area need not be dependent on the shape of the neck. For a circular target area, the quoted area ratio of 3:1 gives a diameter ratio of $\sqrt{3}$:1. The diameter ratio is more usually >2:1, preferably >2.5:1. Considering a minimum neck diameter of 4 mm, the diameter of the target aperture will preferably be from 8 to 16 mm, such as around 12 mm. With a neck diameter of 7 mm, the target area diameter is advantageously around 15 mm.

The neck of the ampoule may be of any shape suitable for mating with the head of a syringe. A luer neck forms one preferred embodiment, a large proportion of syringes having luer heads. However, in accordance with a preferred feature of the present invention, there is provided a neck wherein adjacent walls are substantially parallel. Ampoules with such tubular necks are easier to manufacture, allow easier mating with the syringe head, and are no less efficient than standardised necks. Further, such necks need not be of circular cross-section and are particularly suitable for use in connection with the vacuum-relief means defined above. Other types of neck are also of use, and types of cone will be apparent to those skilled in the art.

Where the neck corresponds to a female cone, it is generally necessary to have the neck extend a short way, such as 2–3 mm, to define the cone. Of course, longer necks are equally possible. However, in the preferred instance, where the sides of the neck are parallel, while the neck may have a significant depth, it need be nothing more than a suitable constriction of the opening.

Thus, a particularly preferred embodiment of the invention provides an opening having a round docking area, a funnel leading to an oval neck, the neck effectively being no more than an aperture defined at the junction of the funnel and the body of the ampoule.

The ampoules of this invention are typically manufactured by the blow-fill-seal method, although any suitable method may be employed. Thermoformable plastics are preferred, especially polyethylene and polypropylene.

The frangible portion, membrane, or break-line, connecting the head to the opening may be formed by any means suitable. If the ampoule is formed by the blow-fill-seal method, the break-line is typically formed by the use of a cutter located about the 'blow nozzle'. A cutter external to the ampoule could also be used but tends to be less satisfactory. Other methods of weakening the break-line, such as localised radiation, tend to be more expensive and no better.

The dimensions of the ampoules are selected according to requirements. Typical volumes are 2–20 ml, standard volumes being 2, 5, 10 and 20 ml, but volumes ranging considerably beyond these are feasible. The overall proportions shown in the accompanying drawings form preferred embodiments, the measurements being substantially as shown.

Twisting or snapping off the head will inevitably stress the ampoule to a greater or lesser degree. The portion more susceptible to such stress is generally the opening comprising the neck and funnel (where present), and it is desirable to reinforce this part to prevent damage during opening. Such reinforcement is typically achieved by incorporating supporting walls into the structure in the sagittal plane of the ampoule. Such walls may extend as far as the break-line or beyond but, where they extend beyond, a break-line should be incorporated in the walls so as not to substantially impede removal of the head. Other walls and alternative forms of strengthening will be apparent to those skilled in the art, and may include ribbing and/or thickening of appropriate parts of the ampoule.

Drawings

The present invention is further illustrated by the following non-limiting examples, which refer to the accompanying drawings. In the drawings:

FIGS. 1 and 2 show vertical elevations of an ampoule manufactured in accordance with this invention;

FIGS. 3 and 3A are enlarged illustrations of the neck portion of the ampoule shown in FIGS. 1 and 2 having the head removed, with FIG. 3 showing a vertical cross-section through the diameter of the neck, and FIG. 3A showing a partial top view of the ampoule to illustrate the top view of the neck portion;

FIGS. 4 and 5 show vertical elevations of an alternative ampoule of the invention;

FIG. 6 shows a view from above of the ampoule of FIGS. 4 and 5;

FIGS. 7 and 8 show vertical elevations of a further ampoule of the invention.

Figure 9A:
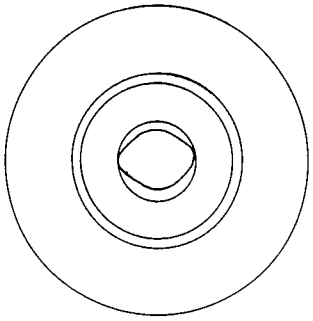
FIGS. 9A, 9B and 9C are top views of three different ampoules illustrating a variety of different neck sections in accordance with the invention, with FIG. 9A showing an oval neck, FIG. 9B showing a generally triangular neck and FIG. 9C showing a generally rectangular neck.
Figure 9B:
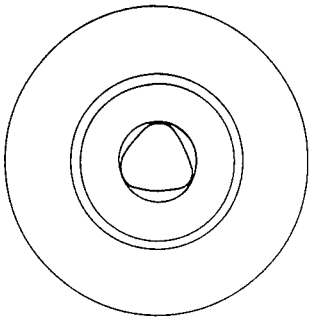
Figure 9C:
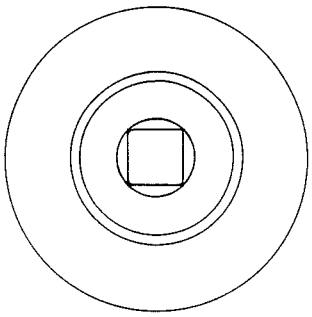

The plastics ampoule 10 of FIGS. 1 to 3 has a removable head 12 which removes to reveal a relatively wide aperture 14 leading to a female luer 16 via a transition 18. The relatively wide aperture acts as a docking target for capturing the male luer of a syringe, and funnelling the syringe male luer towards engagement with the ampoule female luer.

The aperture 14 at the opened end of the ampoule is of circular cross-section, with an internal diameter of about 12 mm, while the luer has a minimum internal diameter of about 4 mm.

The removable head 12 of the ampoule is a twist-off head which can be gripped by a user. The portion 20 to be gripped is relatively thin, and has a moulded surface to facilitate gripping. It extends from a frangible break line 22 around the target area of the aperture, and transforms through a tapering section to a generally rectangular, narrow cross-section. Ancilliary guards 28 are provided in the general plane of the thin grip portion 20 and extending diametrically of the circular base of the head 12.

The female luer 16 has two diametrically opposed grooves 24.

In use, the head 12 can readily be snapped off from the ampoule to reveal the relatively large aperture for receiving the syringe and funnelling it into luer-to-luer engagement. The circular lead face of the head 12 acts as a shield to prevent contact with the aperture of the fingers gripping the thin part of the head. The two grooves 24 in the female luer serve to prevent a build up of vacuum within the ampoule as liquid is drawn up the syringe.

The ampoule of FIGS. 4–6 corresponds to that of FIGS. 1–3 in essential detail. However, the neck **16*a* has parallel walls and is oval in cross-section. In this example, the diameters are about 5 and 7 mm, the larger effectively providing the equivalent of grooves 24 in FIGS. 1–3**.

In this instance, the removable head **12*a* tapers up from the break-line 22*a* to a generally rod-like, hollow grip at an angle from the vertical. In use, the grip can be pulled back to break the frangible membrane 22*a*** to disclose the opening of the ampoule.

FIGS. 7 and 8 represent side and front views of a further ampoule of the invention. Again, the ampoule essentially corresponds to the other two embodiments illustrated, but varies in the neck and head. Neck **16*b*** is essentially a constriction of the ampoule and is generally oval in cross-section its depth being no more than is made necessary by the thickness of the plastic.

Head **12*b* has a moulded grip 20*b* which tapers gradually to its tip, the grip 20*b* having an essentially rectangular cross-section. The double-headed arrow (FIG. 7) shows suitable directions for forcing the grip 20*b* to cause rupture of break-line 22**. Arrows A and B indicate alternative sizes for the ampoule. When constructed to substantially the dimensions shown, size A is suitable to hold a dose of 10 ml, while size B is suitable for a dose of 20 ml.

In the embodiments of the Figures, walls 28, **28*a* and 28*b*** provide support means to strengthen the ampoule when the head is removed. Any other suitable strengthening means, if any is required, may also be used, for example, reinforced walls (ribbing or thickened walls).

It will be appreciated that the foregoing is not an exhaustive description of the invention, which should be interpreted in accordance with the appended claims.

We claim:

1. A plastic ampoule having an internal cavity adapted to contain a liquid, a single opening to said internal cavity and a removable head, said opening comprising a dispensing neck extending from said internal cavity to a mouth of said opening, said removable head sealing said opening, said neck adapted to receive and engage a syringe head for the purpose of withdrawing liquid from said cavity, and a vacuum-relief vent means being provided to prevent a build-up of vacuum within said ampoule upon withdrawal of liquid from said cavity, said vent means being contoured into said neck.

2. The ampoule of claim 1 wherein said vacuum relief vent means comprises at least one duct between the mouth of said opening and said internal cavity.

3. The ampoule of claim 1 wherein said vacuum-relief vent means comprises at least one duct in the form of an open channel on an inside surface of said neck, said duct connecting the mouth of said opening and the internal cavity of said ampoule.

4. The ampoule of claim 1 wherein the internal cross-section of said neck is circular.

5. The ampoule of claim 1 wherein said neck is in the form of a female cone.

6. The ampoule of claim 1 wherein adjacent internal walls of said neck are substantially parallel.

7. The ampoule of claim 3 wherein the internal cross-section of said neck is non-circular, said channels being formed by the areas of the shape defined by said cross-section which extend beyond the minimum diameter of said shape.

8. The ampoule of claim 3 wherein the internal cross-section of said neck is oval, the larger diameter providing said channels.

9. The ampoule of claim 1 wherein said opening further comprises a funnel leading to said dispensing neck.

10. The ampoule of claim 1 further comprising means for rigidifying said opening.

11. An ampoule according to claim 1 wherein said head has a base portion corresponding to the contours of said opening and is sealed thereto by a frangible portion, said head extending away from said opening and tapering towards a grip.

12. The ampoule of claim 11 wherein said opening further comprises a funnel leading to said dispensing neck.

13. The ampoule of claim 11 further comprising means for rigidifying said opening.

* * * * *